US010971344B2

(12) United States Patent
Remes

(10) Patent No.: US 10,971,344 B2
(45) Date of Patent: Apr. 6, 2021

(54) OPTIMIZED STEPPED COLLISION ENERGY SCHEME FOR TANDEM MASS SPECTROMETRY

(71) Applicant: Thermo Finnigan LLC, San Jose, CA (US)

(72) Inventor: Philip M. Remes, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 398 days.

(21) Appl. No.: 16/125,521

(22) Filed: Sep. 7, 2018

(65) Prior Publication Data

US 2020/0083031 A1 Mar. 12, 2020

(51) Int. Cl.
*H01J 49/00* (2006.01)
*H01J 49/42* (2006.01)

(52) U.S. Cl.
CPC ..... *H01J 49/005* (2013.01); *H01J 49/0031* (2013.01); *H01J 49/4215* (2013.01)

(58) Field of Classification Search
CPC ... H01J 49/005; H01J 49/4215; H01J 49/0031
See application file for complete search history.

(56) References Cited

U.S. PATENT DOCUMENTS 7,351,957 B2 4/2008 Bloomfield et al.
7,541,575 B2 6/2009 Lock et al.
8,278,620 B2 10/2012 Schwartz et al.
8,921,773 B2 12/2014 Geromanos et al.
9,111,736 B2 * 8/2015 Asano ..... H01J 49/0009
2005/0277789 A1 12/2005 Bloomfield et al.
(Continued)

FOREIGN PATENT DOCUMENTS

EP 2782116 A1 9/2014

OTHER PUBLICATIONS

Ao et al., "Identification, characteristics and human exposure assessments of triclosan, bisphenol-A, and four commonly used organic UV filters in indoor dust collected from Shanghai, China", Chemosphere 184 (2017), pp. 575-583.
(Continued)

*Primary Examiner* — David E Smith
*Assistant Examiner* — Hsien C Tsai
(74) *Attorney, Agent, or Firm* — Thomas F. Cooney

(57) ABSTRACT

A method for mass spectrometry comprises: receiving or generating a respective value of an optimal collision energy for generating each one of a plurality of n product-ion species of interest from at least one precursor-ion species, each optimal collision energy corresponding to a respective maximum fragmentation efficiency; determining a number, m, wherein m<n, of precursor-ion collision energy values required to fragment all of the at least one precursor-ion species such that a fragmentation efficiency of each product-ion species of interest generated by the fragmentation is equal to the respective maximum fragmentation efficiency, within a pre-determined tolerance; and performing a mass spectrometric analysis that includes fragmenting the one or more precursor-ion species in a collision cell by imparting, in sequence, each of and only the m precursor-ion collision energy values to ions received from an ion source.

5 Claims, 8 Drawing Sheets

(56) References Cited

U.S. PATENT DOCUMENTS

2018/0218893 A1 8/2018 Shiohama

OTHER PUBLICATIONS

Lam et al., "An MRM-based workflow for quantifying cardiac mitochondrial protein phosphorylation in murine and human tissue", Journal of Proteomics 75 (2012), pp. 4602-4609.
Geiger, et al., "Proteomics on an Orbitrap Benchtop Mass Spectrometer Using All-ion Fragmentation", Molecular & Cellular Proteomics 9.10 (2010), pp. 2252-2261.
Hoffman, et al. "Multiple Neutral Loss Monitoring (MNM): A Multiplexed Method for Post-Translational Modification Screening," J Am Soc Mass Spectrom 2006 (17), 307-317.
Huddleston et al., "Selective Detection of Phosphopeptides in Complex Mixtures by Electrospray Liquid Chromatography / Mass Spectrometry", J Am Soc Mass Spectrom 1993, 4, pp. 710-717.
Niggeweg et al., "A general precursor ion-like scanning mode on quadrupole-TOF instruments compatible with chromatographic separation", Proteomics 2006, 6, pp. 41-53.
Oberacher et al., "Automated De Novo Sequencing of Nucleic Acids by Liquid Chromatography-Tandem Mass Spectrometry", J Am Soc Mass Spectrom 2004, 15, pp. 32-42.
Thermo Scientific, "Enhanced Fragmentation of Small Molecules in a Thermo Scientific LTQ™ Linear Ion Trap Mass Spectrometer Using Stepped Normalized Collision Energy", Product Support Bulletin 121, http://tools.thermofisher.com/content/sfs/brochures/PSB-121-Enhanced-Fragmentation-of-Small-Molecules-in-a-LTQ-Linear-Ion-Trap-MS.pdf, 2 pages.
Vijlder et al., "A tutorial in small molecule identification via electrospray ionization-mass spectrometry: The practical at of structural elucidation", Mass Spec Rev. 2018, 37, pp. 607-629.

* cited by examiner

OPTIMIZED STEPPED COLLISION ENERGY SCHEME FOR TANDEM MASS SPECTROMETRY

FIELD OF THE INVENTION

The present invention relates to the field of mass spectrometry. More particularly, the present invention relates to targeted tandem mass spectrometry in which one or more analytes of interest are searched for and/or quantified by detection and measurement of product ions generated in a collision cell.

BACKGROUND OF THE INVENTION

In the field of tandem mass spectrometry, so-called "full-scan mode" is an analytical procedure in which a population of precursor ions is fragmented to produce a single mass spectrum that comprises intensities for a plurality of product-ion species together comprising a range of mass-to-charge (m/z) ratio values. Nearly all mass spectrometers can be operated in such a mode. By contrast, the single reaction monitoring (SRM) mode and the multiple reaction monitoring (MRM) mode are most commonly performed using a triple-quadrupole mass spectrometer (common shorthand notation, "QqQ"), in which mass spectral data acquisition comprises the measurement of a one or more precursor/product ion pairs. During each measurement corresponding to a particular precursor-ion/product-ion pair, a first quadrupole (Q1) is set to transmit only a selected particular limited precursor-ion m/z range while filtering out all other ranges and, subsequently, the so-isolated selected precursor is fragmented at a particular collision energy in a second quadruple (q2) operated as a fragmentation cell. A third quadrupole (Q3) is set to transmit a particular resultant product-ion m/z to a detector and the so-detected product-ion signal, as integrated during a time period, is thereby recorded.

Some mass spectrometers do not have a true SRM or MRM mode of operation. In such apparatuses, the intensities of a wide range of product-ion m/z values are recorded after accumulating a particular precursor m/z and then fragmenting the accumulated ions. Examples of this type of instrument, which are here termed "full scan instruments", are time-of-flight (TOF) mass spectrometers, ORBITRAP™ and other electrostatic-trap-type mass analyzers and mass spectrometers, Fourier Transform ion cyclotron resonance (FT-ICR) mass analyzers, and quadrupole ion trap mass analyzers and mass spectrometers. Of these various mass spectrometer instruments, only the Fourier transform based instruments (FT-ICR, ORBITRAP™ and other electrostatic-trap-type mass analyzers and mass spectrometers) measure the intensities of all the product ions in a truly simultaneous fashion. For the remainder of the so-called full-scan instruments, the condition $\delta t \ll t_{dwell}$ holds (where the symbol "<<" may be taken to mean "less than 5% of"). In other words, in the case of these other instruments, the ratio of the time increment, $\delta t$, required to analyze an m/z increment is much smaller than the dwell time, $t_{dwell}$, that is used to accumulate the ions in the spectrum. Accordingly, these instruments are able to measure the intensities of product ions in an essentially simultaneous fashion and are therefore included in the category of "full-scan" instruments. By contrast, in the case of the QqQ instrument, $\delta t = t_{dwell}$. Nonetheless, it should be noted that a QqQ mass spectrometer can also generate a full scan tandem mass spectrum by concatenating multiple individual product-ion species measurements over a scanned range of Q3 settings. However, this is usually not the most analytically-relevant mode for that type of apparatus.

A typical QqQ MRM analytical protocol calls for the measurement of multiple product-ion species, comprising respective m/z values, that are generated by fragmentation of a given precursor-ion species, so that the ratio of the product-ion intensities can serve as a measure of confidence that the analyte of interest is actually present. In this scenario, the various product-ion species are simultaneously produced by fragmenting the precursor-ion species in the collision cell under the application of a single collision energy that has been chosen so as to produce a range of product-ion species. In an ideal situation for a full scan instrument, the multiple product-ion species are optimally produced at nearly the same collision energy, $E_1$, thus requiring only a single accumulation of the precursor ions followed by a single fragmentation under the application of the collision energy $E_1$, and a single m/z analysis event. This ideal situation is associated with the greatest measurement efficiency, since the maximum quantities of all product ions are generated in a single ion accumulation and fragmentation event instead of in multiple accumulation and fragmentation events. However, sometimes different collision energies are required for optimal production of the various product-ion species. In such scenarios, some product-ion species may be produced at low efficiency, as exemplified by the product-ion species indicated by a star symbol in the lowermost mass spectrum 104 of the anti-parasitic veterinary drug Closantel depicted in FIG. 1. The less-than-maximal generation of some product-ion species as a result of the application of a non-optimal collision energy may lead to the problem low confidence of detection of a targeted analyte and/or low detection sensitivity.

To solve the above-noted problem, the concept of stepped collision energy was introduced, in which a single spectrum contains ions fragmented at a series of collision energies. This concept was described, for example, by Carr and coworkers (Huddleston, Michael J., Roland S. Annan, Mark F. Bean, and Steven A. Carr. "Selective detection of phosphopeptides in complex mixtures by electrospray liquid chromatography/mass spectrometry." *Journal of the American Society for Mass Spectrometry* 4, no. 9 (1993): 710-717) in a study of phosphopeptides. As described in that study, an orifice region collision energy was incrementally stepped to different values as a quadrupole mass filter was ramped to produce a full scan MS/MS spectrum of the product ions. Specifically, two collision energies were employed, a first collision energy for "declustering" and another collision energy for "diagnostic fragments". Later, this concept was extended to analytical studies employing linear ion trap and ORBITRAP™ mass spectrometers ("Enhanced Fragmentation of Small Molecules in a Thermo Scientific LTQ Linear Ion Trap Mass Spectrometer Using Stepped Collision Energy". Thermo Fisher Product Support Bulletin 121; Geiger, Tamar, Juergen Cox, and Matthias Mann. "Proteomics on an Orbitrap benchtop mass spectrometer using all ion fragmentation." Molecular & Cellular Proteomics (2010): mcp-M110; U.S. Pat. No. 7,351,957

To date, the stepped collision energy concept has only been applied to the problem of determining a collision energy procedure to produce acceptable fragmentation for a wide range of generic analytes, without specifying how to set the number of events and their collision energies in a customized way for each analyte. The stepped collision energy procedures described in the art perform a series of accumulation events for each precursor, at a plurality of collision energies, which are agnostic to the identity of the precursor except for its m/z (by way of the "normalized" collision energy scheme), followed by a single m/z analysis event. This is typically specified as a nominal normalized collision energy and two others collision energies that are lower and higher by some amount, for example 35%+/−10%.

In the present study, to determine the range of variability of optimal collision energies, a set of 280 pesticides were characterized to find the collision energy that optimized the sum of all product ions (FIG. 2). It is observed that, especially in the case of beam-type fragmentation (FIG. 2A), the optimal collision energies cannot be simply correlated to the mass of the precursor ion, so they need to be determined individually, if only a single energy is to be used. In the case of some pesticides in which collision energy is supplied by resonant excitation (rCID) within a quadrupole (FIG. 2B), the prior-art strategies may allow one to obtain reasonably good fragmentation coverage. Nonetheless, there may be some compounds for which the general prior-art stepped collision energy procedure is unable to yield optimal fragmentation of the products of interest. Thus, there is a need in the art of tandem mass spectrometry for methods of full-scan operation that are more specific in optimizing the number of fragmentation events, and the collision energies used for each such event.

SUMMARY

This disclosure teaches methods for obtaining targeted MS/MS spectra from a mass spectrometer in "full scan mode" in an optimal way. In particular, this disclosure teaches improved methods of operating a full scan instrument or of operating a QqQ mass spectrometer so as to generate a full scan tandem mass spectrum so that MS/MS spectra are produced using a plurality of fragmentation events at different collision energies, wherein the number of ion accumulation and fragmentation events is the minimal number that allows for each of the product ions of interest to be formed with a collision energy in the neighborhood of its optimal value. The novel methods of operation taught herein use the minimal number of accumulation events that give the desired fragmentation for each analyte. These methods can be especially helpful when multiple reaction monitoring methods from a triple quadrupole instrument are transferred to a full scan MS/MS instrument.

According to a first aspect of the present teachings, a method for mass spectrometry is disclosed, the method comprising: receiving or generating a respective value of an optimal collision energy for generating each one of a plurality of n product-ion species of interest from at least one precursor-ion species, each optimal collision energy corresponding to a respective maximum fragmentation efficiency; and performing a mass spectrometric analysis that includes fragmenting the at least one precursor-ion species in a collision cell by imparting, in sequence, each of and only the n optimal collision energy values to ions received from an ion source. In some instances, the n optimal collision energy values may be imparted to the received ions in an ordered sequence of either progressively increasing or progressively decreasing collision energy values.

According to a second aspect of the present teachings, a method for mass spectrometry is disclosed, the method comprising: receiving or generating a respective value of an optimal collision energy for generating each one of a plurality of n product-ion species of interest from at least one precursor-ion species, each optimal collision energy corresponding to a respective maximum fragmentation efficiency; determining a number, m, wherein m<n, of precursor-ion collision energy values, each precursor-ion collision energy value corresponding to a respective fragmentation event in which one or more of the product-ion species are generated, that are required to fragment all of the at least one precursor-ion species such that a fragmentation efficiency of each product-ion species of interest generated by the fragmentation is equal to, within a pre-determined tolerance, the respective maximum fragmentation efficiency; and performing a mass spectrometric analysis that includes fragmenting the at least one precursor-ion species in a collision cell by imparting, in sequence, each of and only the m precursor-ion collision energy values to ions received from an ion source. In some instances, the m optimal collision energy values may be imparted to the received ions in an ordered sequence of either progressively increasing or progressively decreasing collision energy values. In some instances, each of the at least one precursor-ion species may be purified or partially purified prior to its introduction into the collision cell. In some instances, the product ions generated within the collision cell may be accumulated together within an ion trap. If the product ions are so accumulated, then the accumulated product ions may be mass analyzed simultaneously within a mass analyzer.

According to a third aspect of the present teachings, a method for mass spectrometry is disclosed, the method comprising: receiving or generating a respective value of an optimal collision energy for generating each one of a plurality of n product-ion species of interest from at least one precursor-ion species, each optimal collision energy corresponding to a respective maximum fragmentation efficiency; determining a number, m, wherein m<n, of precursor-ion collision energy values, each precursor-ion collision energy value corresponding to a respective fragmentation event in which one or more of the product-ion species are generated, that are required to fragment all of the at least one precursor-ion species such that each optimal collision energy value is within a predetermined collision energy range of at least one of the precursor-ion collision energy values; and performing a mass spectrometric analysis that includes fragmenting the at least one precursor-ion species in a collision cell by imparting, in sequence, each of and only the m precursor-ion collision energy values to ions received from an ion source. In some instances, the m optimal collision energy values may be imparted to the received ions in an ordered sequence of either progressively increasing or progressively decreasing collision energy values. In some instances, each of the at least one precursor-ion species may be purified or partially purified prior to its introduction into the collision cell. In some instances, the product ions generated within the collision cell may be accumulated together within an ion trap. If the product ions are so accumulated, then the accumulated product ions may be mass analyzed simultaneously within a mass analyzer.

BRIEF DESCRIPTION OF THE DRAWINGS

The above noted and various other aspects of the present invention will become further apparent from the following description which is given by way of example only and with reference to the accompanying drawings, not drawn to scale, in which.

DETAILED DESCRIPTION

Figure 1:
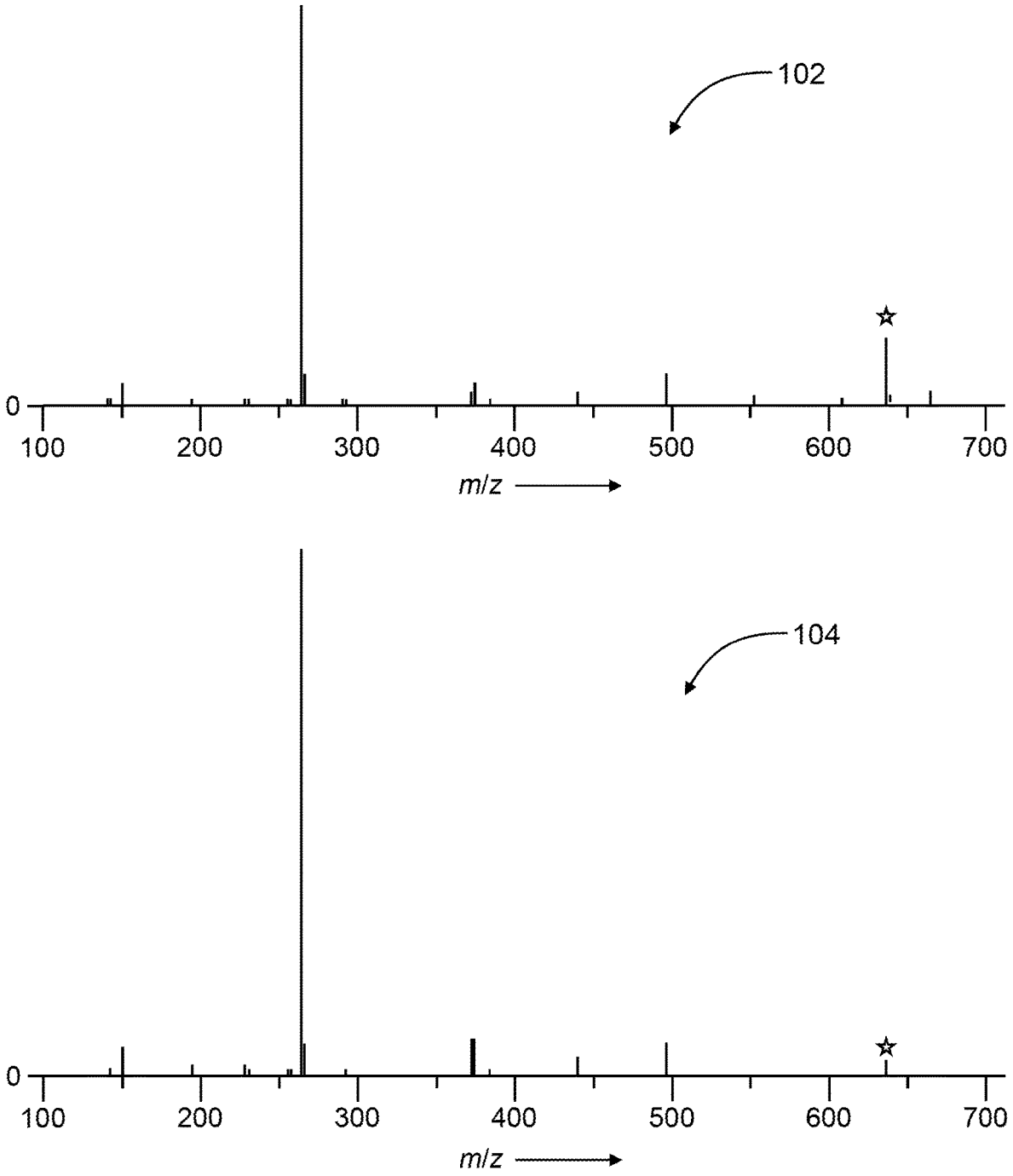
FIG. 1 is a comparison of MS-2 spectra of the anti-parasitic veterinary drug Closantel when fragmented with a single collision energy (bottom) versus when fragmented using multiple fragmentation events optimized at different collision energies for the two fragments of interest (top)
Figure 2A:
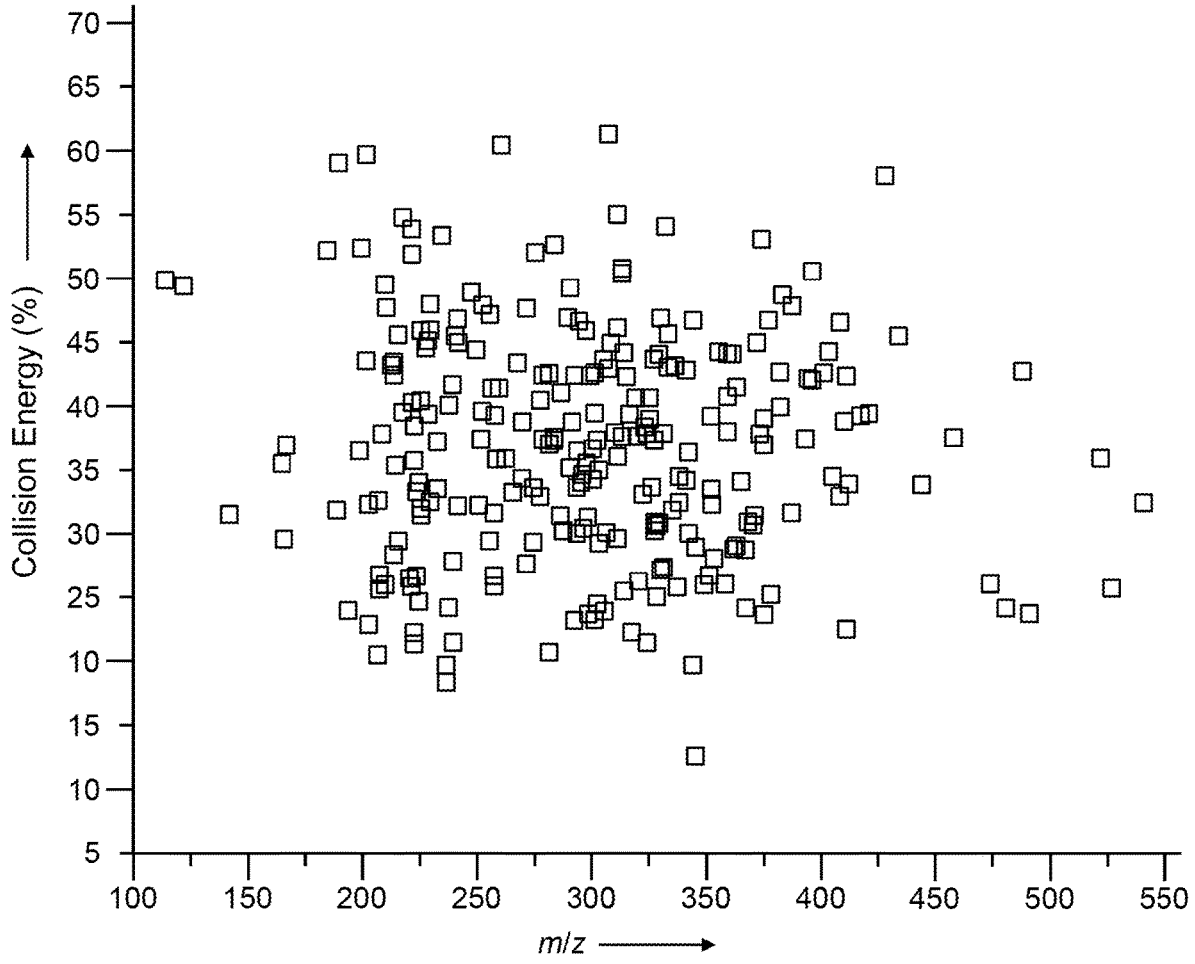
FIG. 2A is a scatter plot of optimized collision energies for 280 pesticides, when fragmented with beam-type collision induced dissociation (bCID)
Figure 2B:
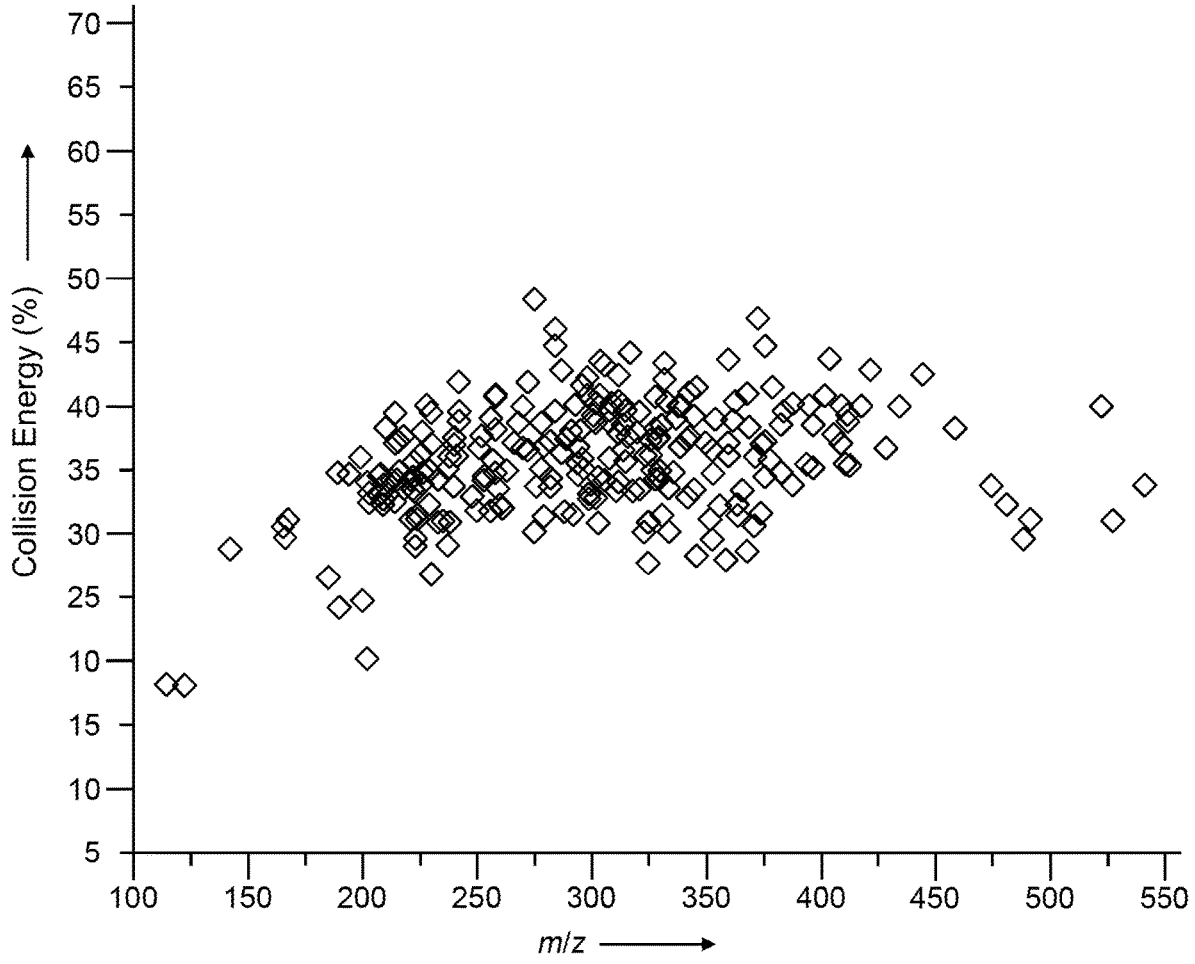
FIG. 2B is scatter plot of optimized collision energies for the 280 pesticides referred to in the caption for FIG. 2A, but when fragmented with resonance collision induced dissociation (rCID)

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the appended FIGS. 1, 2A, 2B, 3A, 3B, 4, 5A and 5B.

In the description of the invention herein, it is understood that a word appearing in the singular encompasses its plural counterpart, and a word appearing in the plural encompasses its singular counterpart, unless implicitly or explicitly understood or stated otherwise. Thus, as used herein, "a" or "an" also may refer to "at least one" or "one or more" unless otherwise stated. Also, unless otherwise stated, the use of "or" is inclusive, such that the phrase "A or B" is true when "A" is true, "B" is true, or both "A" and "B" are true.

It is also to be understood that, for any given component or embodiment described herein, any of the possible candidates or alternatives listed for that component may generally be used individually or in combination with one another, unless implicitly or explicitly understood or stated otherwise. It will be understood that any list of such candidates or alternatives is merely illustrative, not limiting, unless implicitly or explicitly understood or stated otherwise. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements.

Unless otherwise defined, all technical and scientific terms used herein have the meaning commonly understood by one of ordinary skill in the art to which this invention belongs. In case of conflict, the present specification, including definitions, will control. It will also be appreciated that there is an implied "about" prior to the quantitative terms mentioned in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting.

As used in this document, the term "transition" (sometimes also referred as a "reaction") refers to a sequence of events in which: a precursor-ion species of interest comprising a mass-to-charge value of $(m/z)_p$, is purified or partially purified; the purified or partially purified precursor-ion species is/are fragmented in a fragmentation cell or collision cell so as to generate product ions of a plurality of product-ion species having mass-to-charge values, $(m/z)_{f1}$, $(m/z)_{f2}$, $(m/z)_{f3}$, . . . ; and the product-ion species are mass analyzed in order to verify their presence and/or to measure their abundances or relative abundances. As used in this document, the term "fragmentation event" refers to fragmentation of ions comprising one or a plurality of ion species of interest within a fragmentation cell or collision cell that is operated so as to impart a same collision energy to all of the ions. If ions of more than one ion species are fragmented in the fragmentation event, they may be fragmented either sequentially or simultaneously. For example, sequential fragmentation during the fragmentation event may comprise providing a continuous stream of ions to the fragmentation or collision cell, wherein the different ion species are introduced into the ion streams at different respective times. Alternatively, simultaneous fragmentation may comprise an initial step of accumulating the various different precursor ion species within an ion storage device and subsequently releasing the mixture of ions into the fragmentation or collision cell.

Once generated within a fragmentation cell or collision cell, product ions may be transmitted directly to a mass analyzer having a detector for mass analysis and detection. Alternatively, the product ions generated by either a single fragmentation event or a plurality of fragmentation events, as defined above, may be accumulated as a mixture of ion species within an ion storage device prior to their introduction into a mass analyzer. The mixture of product ion species may be than transferred to a mass analyzer having a detector for simultaneous mass analysis and detection. Alternatively, the ion storage device may itself be the mass analyzer. Such simultaneous mass analysis and detection is generally performed by a full-scan apparatus as defined above. Also, the phrase "simultaneous mass analysis" should be understood to apply to general situations in which $\delta t \ll t_{dwell}$ (where $\delta t$ is the incremental time required for a mass spectrometer to analyze an m/z increment and $t_{dwell}$ it the time during which ions are accumulated) and is not intended to be limited to just Fourier transform mass analysis or other modes of mass analysis in which multiple m/z values are truly analyzed simultaneously.

The term "purified", as used above and elsewhere herein, refers to a procedure of eliminating contaminant ions that are not of interest from an ion species of interest. Operationally, this is generally performed by eliminating ions that comprise m/z values that are outside of a certain m/z range about the particular m/z of the ion species of interest such as, for example, outside of a range of ±2 Th or ±1 Th about the particular m/z value. The term "partially purified", as used above, refers to a procedure of eliminating contaminant ions that are not of interest from an ion species of interest having mass-to-charge value of $(m/z)_1$ while, at the same time, retaining other ion species of interest, having mass-to-charge values, $(m/z)_2$, $(m/z)_3$, $(m/z)_4$, . . . together with each other and with the ion species having the mass-to-charge value $(m/z)_1$. According to this definition, an ion species is partially purified when it is co-purified together with other ion species of interest as a mixture. Operationally, this is generally performed by eliminating ions that comprise m/z values that are not within a certain m/z range (such as a ±2 Th or ±1 Th range) about any of $(m/z)_1$, $(m/z)_2$, $(m/z)_3$, $(m/z)_4$, . . . . In some instances, the partial purification may include purifying the various ion species of interest individually and then storing them together in an ion storage apparatus. In some instances, the partial purification may include multi-notch co-isolation within an ion trap or while passing the ions through a quadrupole mass filter. Multi-notch isolation, which is further described in United States pre-Grant Publ. No. 2014/0339421, which is incorporated by reference herein in its entirety, is a procedure in which the ions that are not of interest are all eliminated in a single isolation event.

Figure 3A:
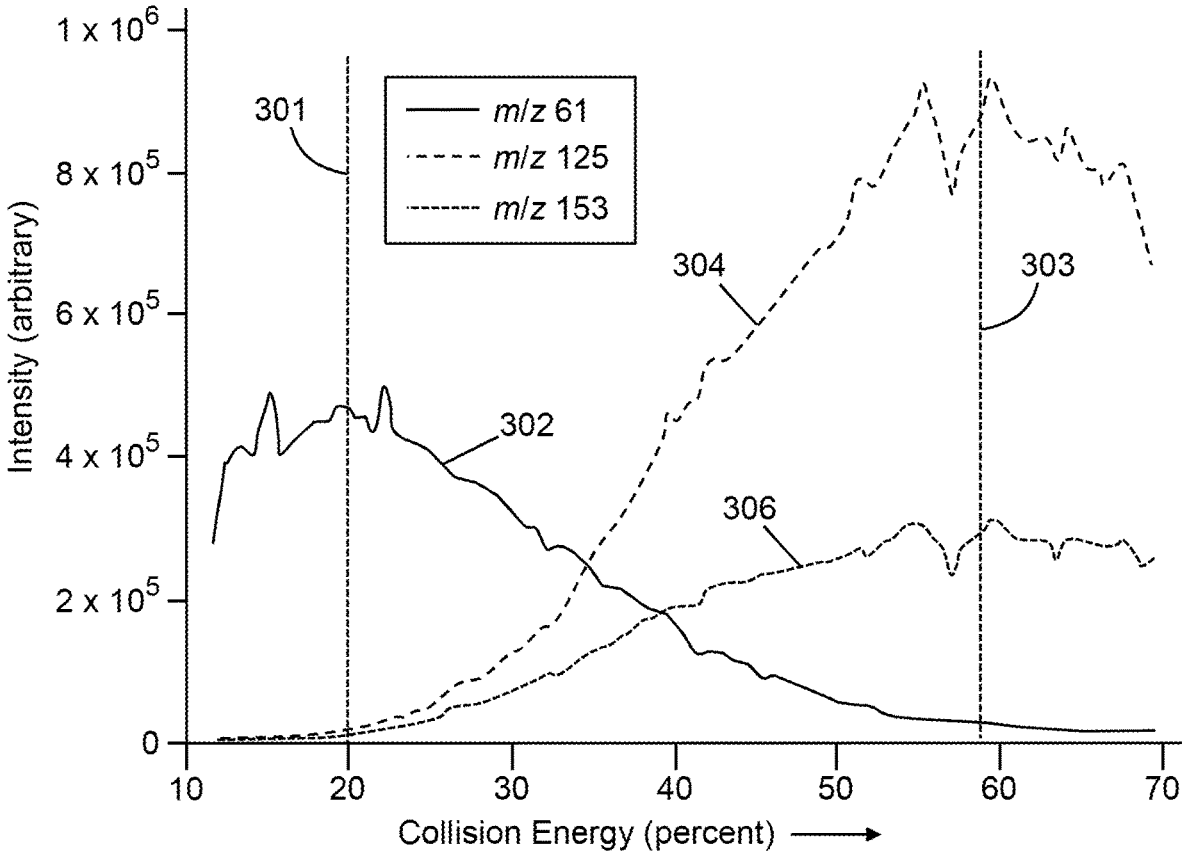
FIG. 3A is a plot of observed intensity of the indicated fragment ions of the herbicide chlorbromuron versus applied collision energy.
Figure 3B:
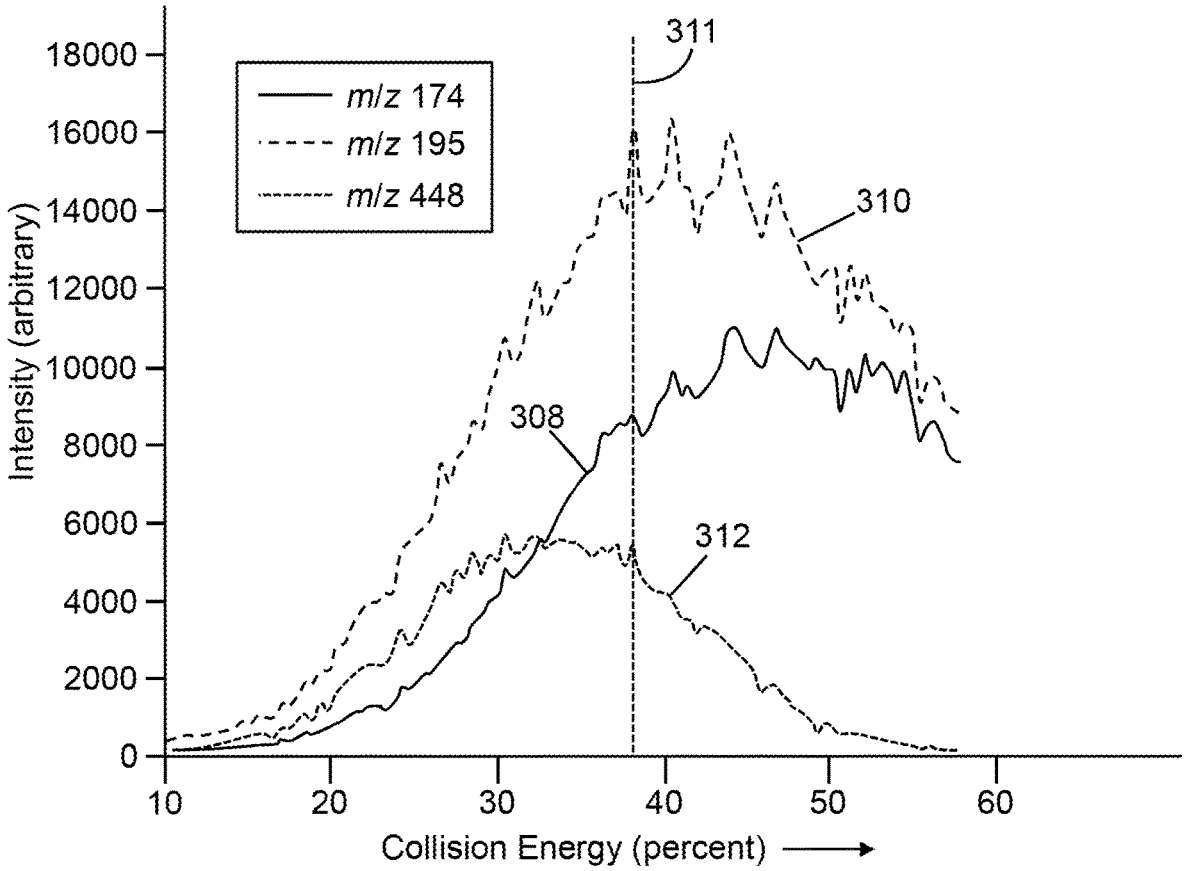
FIG. 3B is a plot of observed intensity of the indicated fragment ions of the antihypertensive drug reserpine versus applied collision energy.

As mentioned above, in the course of developing a QqQ MRM assay, the optimum collision energy is determined for each product ion of interest of each precursor ion. These data can be displayed as intensity versus collision energy, as in FIGS. 3A-3B. FIG. 3A is a plot of observed intensity of the three different principle fragment ions of the herbicide chlorbromuron versus applied collision energy. Trace 302 is the plot for the product ion having m/z value 61 Th; trace 304 is the plot for the product ion having m/z value 125 Th and trace 306 is the plot for the product ion having m/z value 153 Th. FIG. 3B is a plot of observed intensity of the three different fragment ions of the antihypertensive drug reserpine versus applied collision energy. Trace 308 is the plot for the product ion having m/z value 174 Th; trace 310 is the plot for the product ion having m/z value 195 Th and trace 312 is the plot for the product ion having m/z value 448 Th. As may be seen, each of the fragments has a maximum intensity (corresponding to abundance) at a slightly different value of applied collision energy. If, as an example, the applied collision energy were to be set to the optimum energy for the chlorbromuron product ion m/z 125 at 60%, the intensity of the product ion at m/z 61 would be less than optimal (FIG. 3A). In this case, it would be better to accumulate fragments of the precursor in two accumulation events, one at collision energy 20% (position 301) and another near 60% (position 303), so that both product ions are produced with optimal intensities. On the other hand for reserpine, a collision energy of 38% (position 311) gives product ion intensities that are close to the optimum for all three fragments, and so only one accumulation event of the precursor at a single collision energy is needed to produce an acceptable spectrum (FIG. 3B).

Since the intensity, as observed in a mass spectrum, of a mass spectral line corresponding to a particular ion species is related to the abundance of that ion species within a sample of ions and since the abundance of the ion species may vary from sample to sample, it is more useful to refer to "ion fragmentation efficiency", instead of either intensity or abundance in the following discussion. The fragmentation efficiency may be understood as the ratio of the number of fragment ions generated by fragmentation of a precursor ion species to the number of ions of the precursor ion species that are initially available for fragmentation. As may be observed from the data plots of FIGS. 2A-2B and 3A-3B, fragmentation efficiency varies widely among different ion transitions and can vary significantly as a function of applied collision energy, for any given transition.

Figure 4:
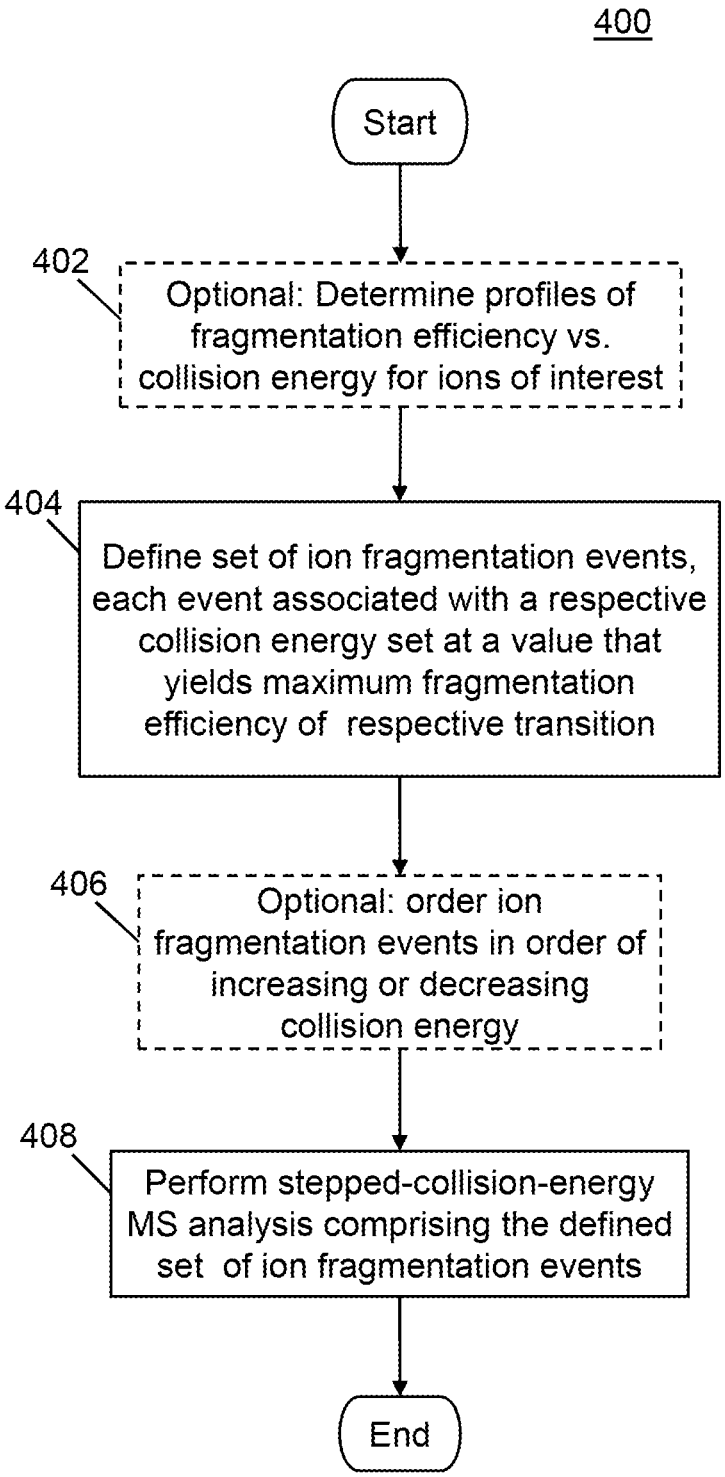
FIG. 4 is a flow diagram of a first method for performing targeted tandem mass spectral analysis in accordance with the present teachings.

FIG. 4 is a flow diagram of a first method for performing targeted tandem mass spectral analysis in accordance with the present teachings. The method 400 that is diagrammed in FIG. 4 takes advantage of known values of fragmentation efficiency so as to yield maximum quantities of product ions of all mass spectral transitions when an experiment comprises interrogation of multiple such transitions. Assuming that there are n such transitions to be investigated (that is, n product-ion species of interest that may possibly be observed upon fragmentation of certain precursor ions), then execution of the method 400 is suitable when none of the n collision-energy tolerance windows of chosen transitions overlap one another—in other words, when the optimal collision energy of each such transition of interest is not within a certain pre-defined tolerance of the optimal collision energy of each other transition of interest. If the optimal collision energy values are not a priori known, then the method 400 may include an optional step 402 of experimentally determining profiles of product-ion efficiency of generation versus applied collision energy (similar to the traces shown in FIGS. 3A-3B) for product ions generated from reference samples of analytes of interest.

Once the values of all n optimal collision energies are known or may be estimated, then a set of n ion fragmentation events is defined in step 404, in which each fragmentation event is associated with a respective collision energy value that yields maximum fragmentation efficiency of a respective transition. In optional step 406, the n defined fragmentation events may be ordered with respect to either increasing or decreasing collision energy. Finally, in step 408, a stepped-collision-energy tandem mass spectrometry experiment is performed, wherein each of the n defined ion-fragmentation events is performed, using the respective associated collision energy value. Although not specifically illustrated in FIG. 4, this step includes repeatedly purifying or partially purifying a respective one of the transition-related precursor ion species and then fragmenting the purified precursor ions in a collision cell using the respective transition-related known or estimated collision energy, thereby generating a set of product ion species. The step 408 further includes analyzing for the presence of a respective particular product ion species within the set of product ions generated by fragmentation of each precursor ion species.

The method illustrated in FIG. 4, as described above, is most applicable in analytical situations in which either: (a) the optimal collision energy of each transition of interest is not within a certain pre-defined tolerance of the optimal collision energy of each other transition of interest or (b) the fragmentation efficiency of each transition is less than a desired threshold value when fragmented using the optimal collision of each other transition. In more-general situations, as described in detail below, the collision-energy tolerance windows of at least some transitions of interest may overlap one another. In such cases, it is desirable, for purposes of efficiency, to simultaneously fragment (i.e., co-fragment) at least some of the precursor-ion species so that the number, m, of ion fragmentation events is reduced to fewer than the number of transitions, n, that are of interest.

Figure 5A:
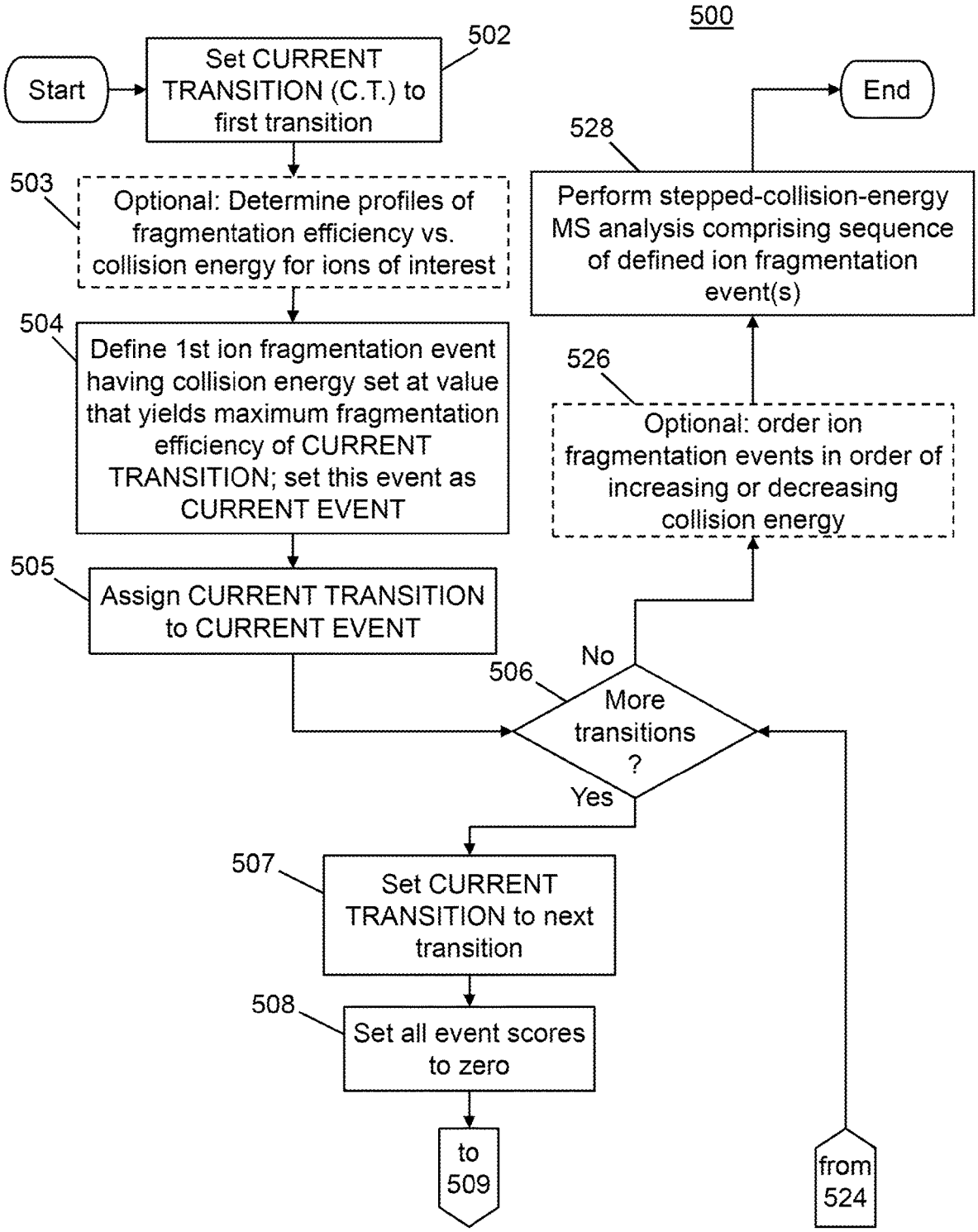
FIG. 5A is a first partial view of a flow diagram of a second method for performing targeted tandem mass spectral analysis in accordance with the present teachings.
Figure 5B:
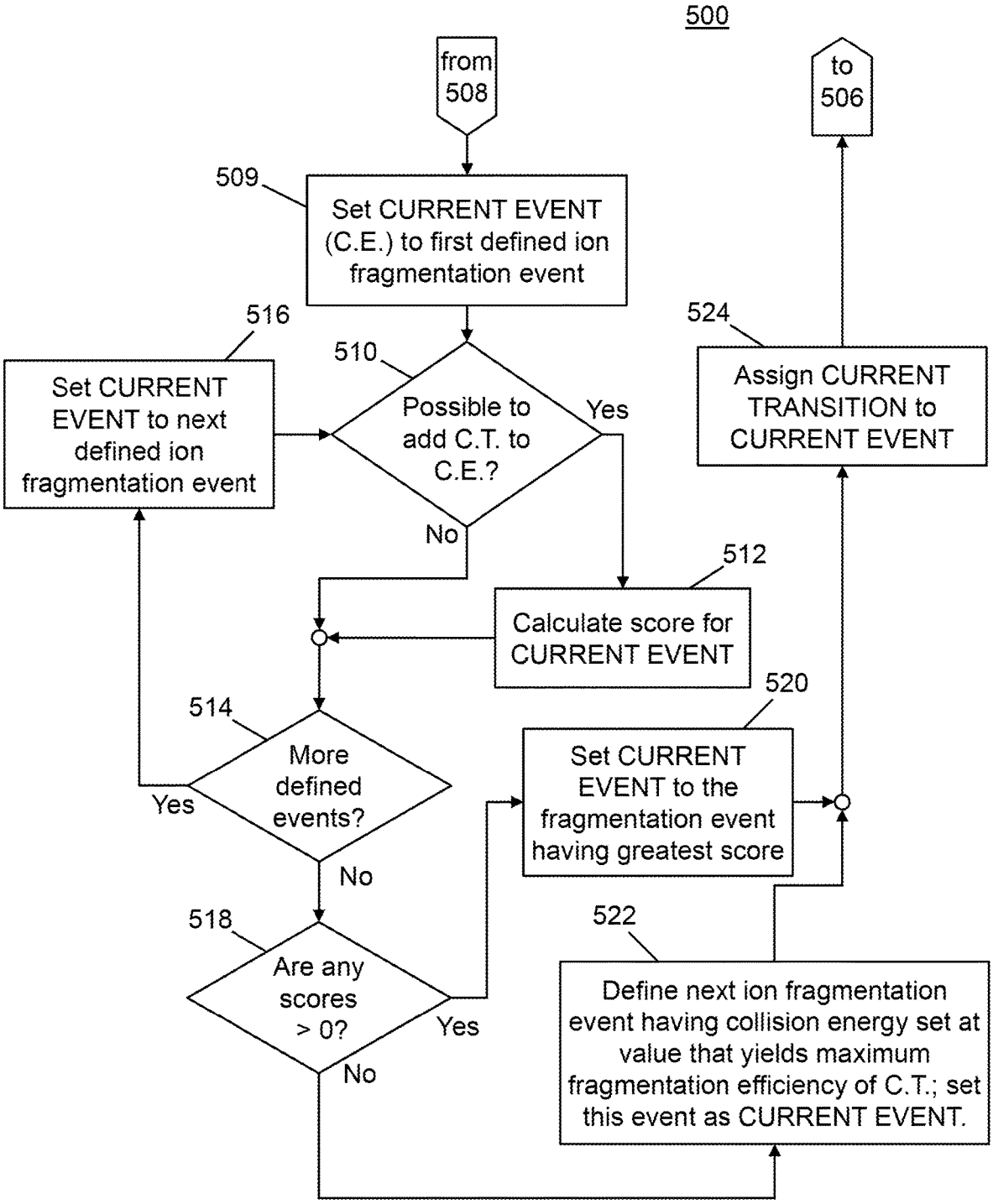
FIG. 5B is a second partial view of the flow diagram of FIG. 5A.

Based on the insight gained from the data of FIGS. 3A-3B as well of other observations, an optimal number of fragmentation events, $m_0$, may be defined as the minimum number of events such that, for each event, the efficiency of generation of each product-ion species generated by the event is within some tolerance—for example, 10%—of its respective maximum. According to an alternative definition, the optimal number of fragmentation events, $m_0$, may be defined as the minimum number of events such that, for each event, the optimal collision energy of each transition is within a certain range of the actual collision energy that is employed in the fragmentation. Accordingly, FIGS. 5A-5B illustrate a second method for performing targeted tandem mass spectral analysis in accordance with the present teachings that reduces the number of required fragmentation events to a number, m, of such fragmentation events such that $m_0 \leq m < n$, where n is the number of transitions of interest and also such that either: (a) for each event, the efficiency of generation of each product-ion species generated by the event is within some tolerance—for example, 10%—of its respective maximum or (b) for each event, the optimal collision energy of each transition is within a certain range of the actual collision energy that is employed in the fragmentation.

As preparation for solving the problem of determining the number, m, let the set T represent a group of total n transitions, t, of interest that are to be investigated during the course of a targeted tandem mass spectral experiment or set of measurements; accordingly, $T=\{t_1, t_2, t_3, \ldots, t_i, \ldots t_n\}$. Each transition is associated with or includes information pertaining to a vector of intensities measured over a range of collision energies, as in FIGS. 3A-3B where each of the traces 302, 304, 306, 308, 310 and 312 is a graphical representation of one such respective vector. Also, let the set G represent a group of total m fragmentation events, g, that are to be conducted during the experiment or set of experiments; accordingly, $G=\{g_1, g_2, \ldots, g_j, \ldots g_m\}$. Each fragmentation event, $g_j$ is associated with or includes information pertaining to a particular collision energy, $E_j$ and is also associated with or includes information pertaining to a list of transitions for which fragmentation is to be performed using that collision energy. It is also convenient to define a set, S, of m numerical scores, s, each individual score corresponding to a respective fragmentation event and providing a measure of the effectiveness of the collision energy corresponding to that event, as described in greater detail below. Accordingly, $S=\{s_1, s_2, \ldots, s_j, \ldots s_m\}$.

The present goal, whose solution is described here and outlined as method 500 in FIGS. 5A-5B, is to pre-populate the set G with a number, m, of fragmentation events, where $m_0 \leq m < n$, and with the appropriate associated collision energies that cause each product-ion species to be produced in a fashion such that some pre-defined fragmentation quality metric is within some tolerance of its "best" value, where the metric may be based on fragmentation efficiency, collision energy value or some other parameter. For purposes of example, the fragmentation quality metric that is employed in the following discussion of FIGS. 5A-5B is "fragmentation efficiency" and the "best" value of fragmentation efficiency is taken as the optimal fragmentation efficiency, which corresponds to the maxima in curves of fragmentation versus collision energy, such as the maxima in curves 302 and 304 depicted in FIG. 3A. In alternative embodiments, the fragmentation quality metric is collision energy (or so-called normalized collision energy, which is measured in percent) and the best or optimal value is taken as the collision energy value that corresponds to the maximum in a curve of fragmentation versus collision energy. For instance, the collision energy values 301 and 303 of FIG. 3A are optimal collision energy values according to this alternative definition. Depending upon the details of a particular experiment and/or a particular apparatus configuration, the n transitions may pertain to just a single precursor ion of a single analyte, to multiple precursor ions of an analyte or to multiple precursors of multiple analytes. There are many different algorithms for determining the number, m, of fragmentation events under the constraints provided above, one of which is outlined as method 500 in FIGS. 5A-5B and further described below.

Referring to FIG. 5A, the method 500 may include an optional step 503 of experimentally determining profiles of product-ion efficiency of generation versus applied collision energy (similar to the traces shown in FIGS. 3A-3B) for product ions generated from reference samples of analytes of interest. Otherwise, in a situation in which an analytical procedure is being transferred from a QqQ apparatus to a full-scan apparatus and detailed information such as that depicted in FIGS. 3A-3B is available, then the method 500 may make use of the existing data. Alternatively, if the only available information for each transition is the optimum or best collision energy (instead of a full trace as in FIGS. 3A-3B), then the tolerance referred to above can be specified as a simple collision energy range about each optimum collision energy value.

In FIGS. 5A-5B and the following discussion, the terms "CURRENT_TRANSITION" and "CURRENT_EVENT" are to be understood as temporary algorithmic or computer program variables, where the variable CURRENT_TRANSITION may refer any of the transitions $t_1, t_2, t_3, \ldots, t_i, \ldots t_n$ and the variable CURRENT_EVENT may refer to any of the fragmentation events $g_1, g_2, \ldots, g_j, \ldots g_m$. For $t_1$, the collision energy corresponding to its maximum efficiency of generation is selected to be used its accumulation event. Accordingly, in step 502 of the method 500, the index i is set to unity so that the program variable CURRENT_TRANSITION is set to refer to transition $t_1$. Accordingly, in step 504, the previously-empty set G is populated with its first element, $g_1$, and this new element is set as the CURRENT_EVENT. This step includes setting the maximum index, m, to unity and setting the first collision energy equal to the collision energy that corresponds to the maximum efficiency of fragment-ion generation of the transition $t_1$. In step 505, the CURRENT_TRANSITION (transition $t_1$ in this instance) is assigned to the current ion-fragmentation event (in this case, the CURRENT_EVENT as set in step 504). This assignment means that, in a subsequent execution of step 528, the precursor ion associated with the CURRENT_TRANSITION will be fragmented using the collision energy associated with the CURRENT_EVENT. This fragmentation may occur simultaneously with the fragmentation of other precursor ions assigned to the same event, possibly subsequent to the co-accumulation of the precursor ion with those other precursor ions. Alternatively, the product ions generated by the fragmentation may be accumulated with and/or co-analyzed with other product ions generated from other respective precursor ions using the same collision energy, even though the fragmentation may not occur simultaneously with the fragmentation of those other precursor ions.

The remainder of the transitions (if any) are then considered in turn in the loop of steps comprising steps 506-526. After the value of the index, i, of the variable CURRENT_TRANSITION is incremented in step 507, then each of the defined events in the set G is considered in turn (through incrementing the index, j, of the program variable CURRENT_EVENT), commencing with step 509 at which fragmentation event $g_1$ is initially considered and continuing, if required, with looped steps 510, 512, 514, and 516 (FIG. 5B) at which the remainder of the fragmentation events are considered. Prior to executing this loop, however, all existing event scores $s_1, s_2, \ldots s_m$ (where the upper index m may vary during the course of execution of the method) are set to zero at step 508 (FIG. 5A). The event scores take account of the fact that it may be possible for a transition to be assigned to more than one fragmentation event. This will be true only if the collision energy associated with the single fragmentation event allows all transitions that are assigned to it to generate fragment ions with intensities within a tolerance of their respective maxima of fragment-ion generation efficiency. If the fragment ions associated with the CURRENT_TRANSITION will not be generated with the requisite efficiency, then the score for CURRENT_EVENT will remain at zero. Otherwise, the score will be set to a non-zero value (at step 512) that is a measure of the expected fragment-ion efficiency of generation of one or more transitions assigned to the ion fragmentation event when fragmented using the collision energy corresponding that event.

At step 510, a determination is made as to whether it is possible to add or assign the transition represented CURRENT_TRANSITION to the fragmentation event represented by CURRENT_EVENT. As noted above, this determination may be based upon whether the collision energy associated with or included in the CURRENT_EVENT can be expected to yield an efficiency of generation of fragment ions, as defined by the CURRENT_TRANSITION, that is within a certain tolerance (such as 10%) of a known efficiency maximum. Alternatively and as noted above, the determination may be based upon whether the collision energy associated with or included in the CURRENT_EVENT is within a certain collision energy range, ΔE, of the optimal collision energy associated with or included in the CURRENT_TRANSITION.

If it is determined, in step 510 of method 500, that the considered transition may be included in the considered fragmentation event, then a score, $s_k$, is calculated in step 512. Otherwise, step 512 is bypassed and the score remains at zero. This calculated score relates to the effectiveness of assigning the CURRENT_TRANSITION to the CURRENT_EVENT that is under consideration and is employed subsequently (step 524) to assign the transition to the ion fragmentation event that yields the maximum fragmentation. If there are additional defined fragmentation events in set G (that is, if index j is less than maximum index m, as determined in step 514), then the index, j, of the variable CURRENT_EVENT is incremented so as to refer to the next fragmentation event in step 516 and then step 510 is repeated using the new values of CURRENT_EVENT.

Each score calculated in step 512 pertains to the potential effectiveness of adding a CURRENT_TRANSITION (C.T.) to each CURRENT_EVENT (C.E.). The scores may be calculated in various ways. One straightforward way of calculating the scores is to always maintain the collision energy values of the various fragmentation events at their initially assigned values (e.g., in step 504 and step 522) and then to assign each score simply as the fragmentation efficiency of the CURRENT_TRANSITION at that invariant collision energy. When using such a score-assignment scheme, then each collision energy value will be the optimal collision energy value of at least one transition (e.g., as set in steps 504 and 522). Alternatively, the assigned collision energy of the CURRENT_EVENT may be allowed to vary within limits when computing the score associated with the addition of a transition to an event. For example, when calculating a score for adding transition $t_2$ to an already-defined fragmentation event $g_1$ that includes transition $t_1$ and whose assigned collision energy is optimal for $t_1$, then, under the invariant collision energy scheme, the calculated score may be zero if the fragmentation efficiency of $t_2$ is only 89% of its optimal value at the collision energy assigned to $g_1$ (under the assumption that the cut-off value is 90% of optimal efficiency). However, by slight adjustment of the assigned collision energy, the fragmentation efficiency of $t_2$ may be brought up to 90% of its optimal value while merely decreasing the fragmentation efficiency of $t_1$ to 98% of its optimal value. This alternative version of the step 512 would then include the adjustment to the collision energy. Accordingly, the adjustable collision energy scheme may, in some circumstances, further reduce the number of fragmentation events required for a particular analytical run. One of ordinary skill in the art may envisage numerous other more-complex score calculation schemes whose calculations include the fragmentation efficiencies of all transitions assigned to a particular fragmentation event. As one such example, the collision energy associated with the event may be taken to be the average of the optimal collision energies for the existing transitions in the event and the prospective CURRENT_TRANSITION.

If it is found, in step 514, that there are no additional already-defined fragment events to which it would be possible to assign the CURRENT_TRANSITION, then execution proceeds to step 518 at which the set of scores is examined to any find non-zero scores. If there are no non-zero scores, then a new fragmentation event is defined (the value of the maximum index, m, is incremented) and added to the set G in step 522. The newly defined ion fragmentation event is associated with the collision energy generates maximum efficiency of fragment-ion generation of the transition (CURRENT_TRANSITION) that is currently under consideration. The newly defined event thus becomes the CURRENT_EVENT and the currently-considered transition is assigned to it in step 524.

On the other hand, if it is determined, in step 514, that there is at least one score that is greater than zero, then there is at least one previously-defined ion fragmentation event that is associated with a collision energy that will yield an efficiency of generation of fragment ions, as defined by the CURRENT_TRANSITION, that is within a certain tolerance (such as 10%) of its known efficiency maximum. Thus, a search is made for the ion fragmentation event that is associated with the greatest score in step 520. The collision energy associated with such an event will yield the best fragmentation, either for the transition under consideration or for a plurality of transitions, depending upon the particular scheme used to calculate the scores. Accordingly, the ion fragmentation event having the greatest score is set to CURRENT_EVENT in step 520 and the currently-considered transition is assigned to it in step 524.

After the assignment of a CURRENT_TRANSITION to an ion fragmentation event is made in step 524, execution of the method 500 returns to step 506, at which a determination is made in step 526, if there are any un-considered transitions remaining in the set T. If so, then the CURRENT_TRANSITION is set to the next transition (index i is incremented) and steps 508-524 are re-executed using the new values associated with that transition. Otherwise, stepped-collision-energy tandem mass spectrometry experiment is performed (step 528), wherein each of the ion-fragmentation events is performed in a mass spectrometer, using the respective associated collision energy values as defined in the earlier steps of the method. Specifically, the step 528 comprises performing a mass spectrometric analysis that includes fragmenting the precursor-ion species in a collision cell by imparting, in sequence, each of and only the m precursor-ion collision energy values to ions provided by an ion source. The ions may be provided from the ion source as a continuous stream. Further, for purposes of efficiency or ease of hardware operation, it may be desirable to cause the m optimal collision energy values to be imparted to the received ions in an ordered sequence of either progressively increasing or progressively decreasing collision energy values. The order may be defined in optional step 526.

If the product ions are mass analyzed simultaneously using a full-scan mass analyzer, as defined herein, then the various fragment ions of one or more precursor ion species that are all assigned to a same fragmentation event may be temporarily accumulated, subsequent to their generation in a collision cell, in an ion trap apparatus. The accumulated product ions may then be transferred, as a batch, to the full-scan mass analyzer for analysis, detection and measurement. If more than one precursor ion species is to be fragmented, then the fragmentation of the various precursor that are assigned to a fragmentation event may occur either simultaneously or non-simultaneously. If the fragmentation of the various precursor ions is simultaneous, then those various precursor ions may be temporarily co-accumulated, in an ion trap apparatus, prior to their release, as a batch, to a collision cell that is operated using the particular collision energy that is associated with the fragmentation event. If the fragmentation of the various precursor ions is non-simultaneous, then an ion selection device, such as a quadrupole mass filter, may be operated so as to transmit the various precursor ions in sequence, one-by-one, to a collision cell while the collision energy at which the collision cell is operated remains unchanged.

The advantage of the methods taught herein is that each analyte uses the minimum number of fragmentation events required to produce acceptable fragmentation. A smaller number of events means that a mass analyzer or mass spectrometer instrument is able to operate with a higher duty cycle. Yet, by tailoring the collision energy of the events to the requirements of all transitions of each analyte, it is ensured, by the methods of the present teachings, that all molecules are sufficiently fragmented. Thus, the presently taught methods are preferable to conventional generic collision-energy selection schemes in which some transitions may not yield a large quantity of fragments. The use of the present methods also ensures that, when an MRM method is transferred from a QqQ instrument to a full scan instrument, there are no problems related to certain transitions having low efficiency of generation.

Improved methods for performing tandem mass spectrometry using stepped collision energy have been disclosed. The discussion included in this application is intended to serve as a basic description. The present invention is not to be limited in scope by the specific embodiments described herein, which are intended as single illustrations of individual aspects of the invention, and functionally equivalent methods and components are within the scope of the invention. Indeed, various modifications of the invention, in addition to those shown and described herein will become apparent to those skilled in the art from the foregoing description and accompanying drawings. Such modifications may fall within the scope of the appended claims. Any patents, patent applications, patent application publications or other literature mentioned herein are hereby incorporated by reference herein in their respective entirety as if fully set forth herein, except that, in the event of any conflict between the incorporated reference and the present specification, the language of the present specification will control.

What is claimed is:

1. A method for mass spectrometry comprising:

receiving or generating a respective value of an optimal collision energy for generating each one of a plurality of n product-ion species of interest from at least one precursor-ion species, each optimal collision energy corresponding to a respective maximum fragmentation efficiency; and performing a mass spectrometric analysis that includes fragmenting the at least one precursor-ion species in a collision cell by imparting, in sequence, each of and only the n optimal collision energy values to ions received from an ion source.

2. A method for mass spectrometry, comprising:

receiving or generating a respective value of an optimal collision energy for generating each one of a plurality of n product-ion species of interest from at least one precursor-ion species, each optimal collision energy corresponding to a respective maximum fragmentation efficiency;

determining a number, m, wherein m<n, of precursor-ion collision energy values, each precursor-ion collision energy value corresponding to a respective fragmentation event in which one or more of the product-ion species are generated, that are required to fragment all of the at least one precursor-ion species such that a fragmentation efficiency of each product-ion species of interest generated by the fragmentation is equal to the respective maximum fragmentation efficiency, within a pre-determined tolerance; and performing a mass spectrometric analysis that includes fragmenting the at least one precursor-ion species in a collision cell by imparting, in sequence, each of and only the m precursor-ion collision energy values to ions received from an ion source.

3. A method for mass spectrometry as recited in claim 2, wherein each of the at least one precursor-ion species is purified prior to its introduction into the collision cell;

wherein product ions generated within the collision cell are accumulated together within an ion trap; and wherein the accumulated product ions are mass analyzed simultaneously within a mass analyzer.

4. A method for mass spectrometry, comprising:

receiving or generating a respective value of an optimal collision energy for generating each one of a plurality of n product-ion species of interest from at least one precursor-ion species, each optimal collision energy corresponding to a respective maximum fragmentation efficiency;

determining a number, m, wherein m<n, of precursor-ion collision energy values, each precursor-ion collision energy value corresponding to a respective fragmentation event in which one or more of the product-ion species are generated, that are required to fragment all of the at least one precursor-ion species such that each optimal collision energy value is within a predetermined collision energy range of at least one of the precursor-ion collision energy values; and performing a mass spectrometric analysis that includes fragmenting the at least one precursor-ion species in a collision cell by imparting, in sequence, each of and only the m precursor-ion collision energy values to ions received from an ion source.

5. A method for mass spectrometry as recited in claim 4, wherein each of the at least one precursor-ion species is purified prior to its introduction into the collision cell;

wherein product ions generated within the collision cell are accumulated together within an ion trap; and wherein the accumulated product ions are mass analyzed simultaneously within a mass analyzer.

* * * * *